United States Patent [19]

Levasseur

[11] 4,061,912

[45] Dec. 6, 1977

[54] FILAMENT ALIGNMENT MECHANISM FOR FOLLOW SPOT OR THE LIKE

[75] Inventor: Craig Levasseur, Calabasas, Calif.

[73] Assignee: Berkey-Colortran, Inc., Burbank, Calif.

[21] Appl. No.: 735,698

[22] Filed: Oct. 26, 1976

[51] Int. Cl.[2] ..... F21V 19/02

[52] U.S. Cl. ..... 362/287; 362/288

[58] Field of Search ..... 240/44.2, 47, 3, 44.27

[56] References Cited

U.S. PATENT DOCUMENTS

| | | | |
|---|---|---|---|
| 1,426,858 | 8/1922 | Godley | 240/44.2 |
| 1,459,700 | 6/1923 | Wetzel | 240/44.2 |

*Primary Examiner*—John Gonzales

*Attorney, Agent, or Firm*—Flam & Flam

[57] ABSTRACT

A spotlight housing has a rear section in which a lamp socket is accommodated. The lamp projects forwardly through the back of a reflector. The lamp socket is mounted on a heat sink. A coil spring is interposed between the heat sink and the rear section of the follow spot housing. A screw threaded rod projects from the back of the heat sink, through the spring and through a large clearance opening in the rear section of the housing where it connects with a positioning knob. The knob is urged against the outside surface of the housing, which is spherically formed with a geometric center located near the access opening to the reflector. By shifting the knob along the surface, the lamp filament can be moved laterally in any direction relative to the reflector axis or focus. By rotating the knob, the rod length changes as the spring compresses and expands, thus moving the filament more or less into the reflector housing as the heat sink limits rotation. The filament thus is universally mounted by the simplest possible means.

6 Claims, 4 Drawing Figures

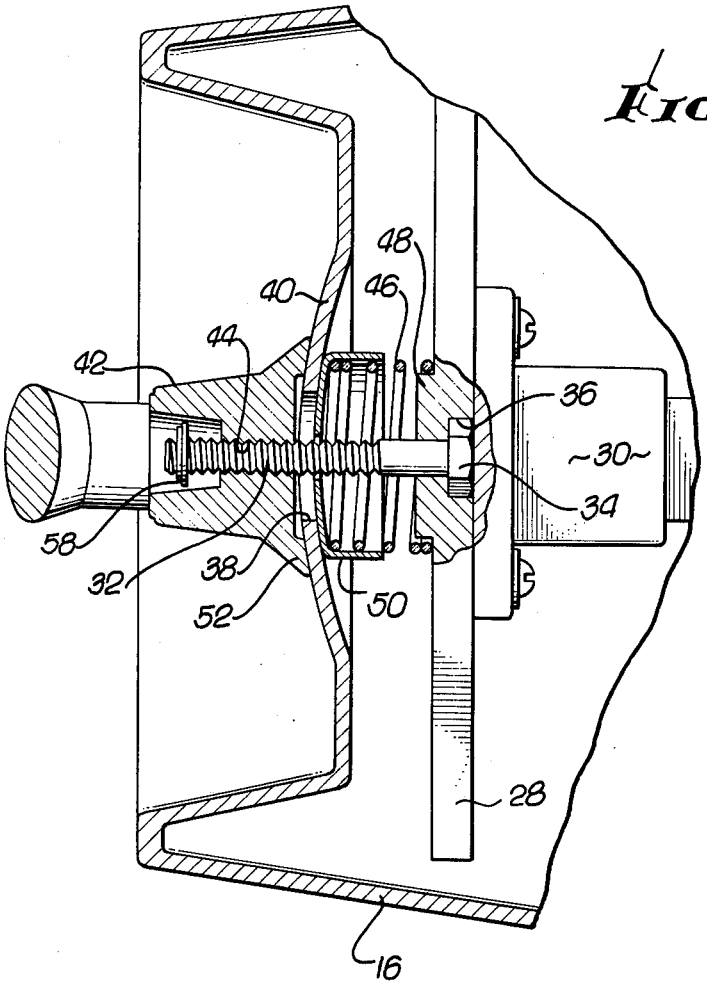
FIG. 3.
FIG. 4.
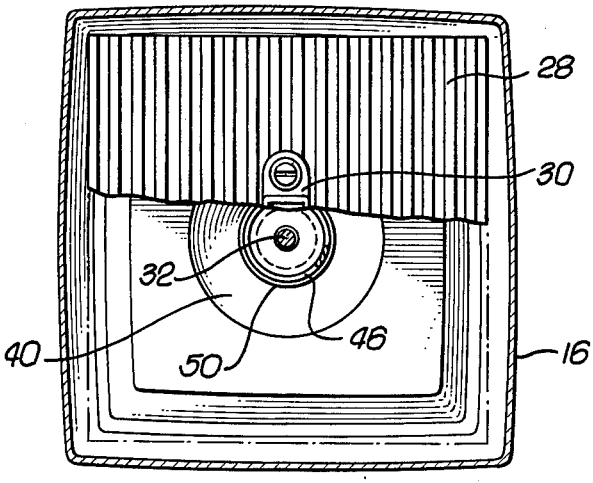

FILAMENT ALIGNMENT MECHANISM FOR FOLLOW SPOT OR THE LIKE

FIELD OF INVENTION

This invention relates to luminaires for stage lighting, and more particularly to a universal mounting for a lamp socket whereby the lamp can readily be positioned along and laterally of, the generally horizontal reflector axis.

BACKGROUND OF THE INVENTION adjustment of lamp filament position in a stage follow spot is absolutely essential upon lamp replacement. Adjustment is often desirable if the filament moves out of position. Moreover, the operator may deliberately move the filament laterally of the reflector axis in a vertical, horizontal or any other plane to achieve various illumination effects.

One known prior art device utilizes a three adjustment screw to tilt and translate the lamp socket. The adjustment is not only tedious, but can be accomplished only with the rear section of the housing open. It is impossible to adjust while the luminaire operates. A second known prior art device utilizes a gimbal mounting which is an improvement over the adjustment screw mechanism. In this second device, a U-shaped bracket has its legs pivoted on a transverse axis that generally intersects the rear end of the lamp housing. The lamp socket is in turn mounted by the U-shaped bracket for shifting movement about an orthogonal axis. The gimbal mounting is bulky and complicated.

The primary object of the present invention is to provide a universal mounting for a filament socket that comprises only a few simple parts but which yet has the capability of achieving filament adjustment in a simple manner while the luminaire is in operation.

SUMMARY OF INVENTION

In order to accomplish the foregoing objects, I utilize a simple friction clamp mechanism that mounts the lamp socket entirely at the spherically curved wall of the rear housing section without any gimbal or other compound mounting mechanism. The clamp mechanism is shiftable along the spherical wall by an external knob that is attached to a mounting rod projecting rearwardly of a heat sink upon which the lamp socket is mounted. The spherical wall alone determines the parameters of lateral movement of the lamp socket about a pivot point located at the back wall of the reflector. A coiled compression spring is interposed between the heat sink and the housing wall to maintain frictional engagement. A screw threaded relationship between the external knob and the rod moves the socket in and out while the coil spring compresses and expands. The heat sink interferes with the inside of the housing to prevent it from rotating with the knob.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

FIG. 3 is a further enlarged axial sectional view similar to FIG. 2, but showing the friction clamp connection in detail.

FIG. 4 is a transverse sectional view showing the inside of the rear housing section, the heat sink being broken away.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 1:
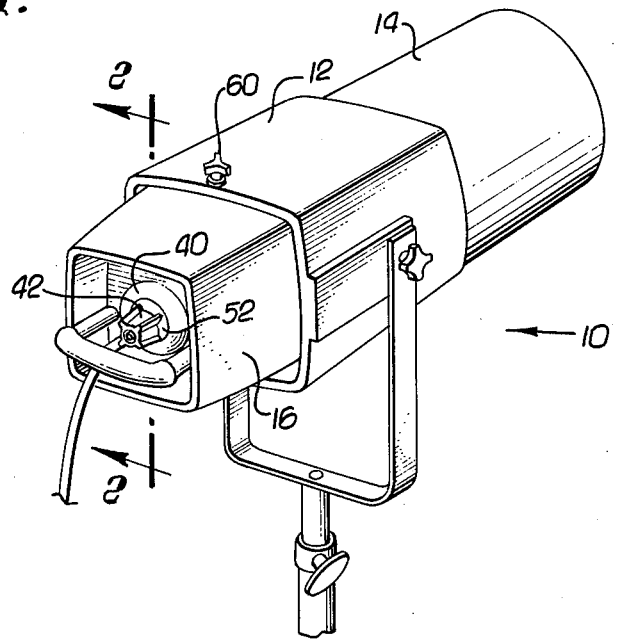
FIG. 1 is a pictorial view of a follow spot incorporating the present invention.

The stage luminaire or spotlight 10 (FIG. 1) in the present instance has a three part housing, a main reflector housing section 12, a lens housing section 14 at the front and a lamp housing section 16 at the back. A reflector 16 inside the housing section 12 is a conic section of revolution, in this instance an ellipsoid. A lamp 20 projects through a rear opening 22 into the reflector 16 to be located substantially at the axis 24 of the reflector and generally at the vicinity of the near focus of the reflector. The lamp 20 has a generally cylindrical glass envelope and a filament typically helically coiled in the envelope.

The characteristics of the spotlight depend upon the position of the filament along the axis and also upon the lateral alignment or misalignment of the filament relative to the reflector axis 24. Accordingly, the lamp 20 is mounted for swivel movement about a pivot point 26 located near, and preferably at, the center of the access opening 22 to the reflector. The proximity of the pivot axis and the access opening 22 makes it possible for the access opening 22 to be only slightly larger than the lamp envelope itself, whereby the least amount of reflector surface is lost. The lamp 20 is also mounted for movement inwardly and outwardly of the reflector opening.

The lamp is mounted by a simple draw screw mechanism shown clearly in FIG. 3. The main support for the lamp is a plate-like heat sink 28 that has a series of ribs or fins for heat transfer to the currents of air. A lamp socket 30 is attached, as by screws, to the front of the heat sink 28. Projecting from the back of the heat sink 28 is a threaded rod 32 which, in the present instance, is the shank of a machine screw. The screw has a noncircular head 34 fitted in a corresponding recess 36 in the front of the heat sink in order to prevent rotation between the rod and the heat sink.

The lamp housing section 16 frictionally mounts the rod 32, and, thereby, the heat sink 28 and the lamp socket 30. For this purpose, the rod 32 projects through a relatively large clearance opening 38 at the center of the housing section 16. The wall 40 surrounding the clearance opening 38 is substantially spherical for reasons presently to appear. Threadedly attached to the projecting end of the rod 32 is a knob 42 that has a through threaded aperture 44 for the rod. The knob 42 is frictionally clamped to the wall 40 by the aid of a coiled compression spring 46. The spring 46 is interposed between the wall 40 and the heat sink 28 and is located in surrounding relationship to the central portion of the rod 32. The inner end of the spring is held in place by a boss 48. A cup 50 guided on the rod captures the other end of the spring and engages the inside surface of the spherical wall. The spring 46 moves the heat sink or lamp socket support 28 to the limit allowed by the draw screw connection between the rod and the knob 42 and causes the knob 42 to engage the outside surface of the wall 40. The knob 42 has a rim 52 formed as a spherical zone in order the fit the wall. The screw part of the draw screw connection could, of course, be attached to the knob 42 rather than the support 28.

Figure 2:
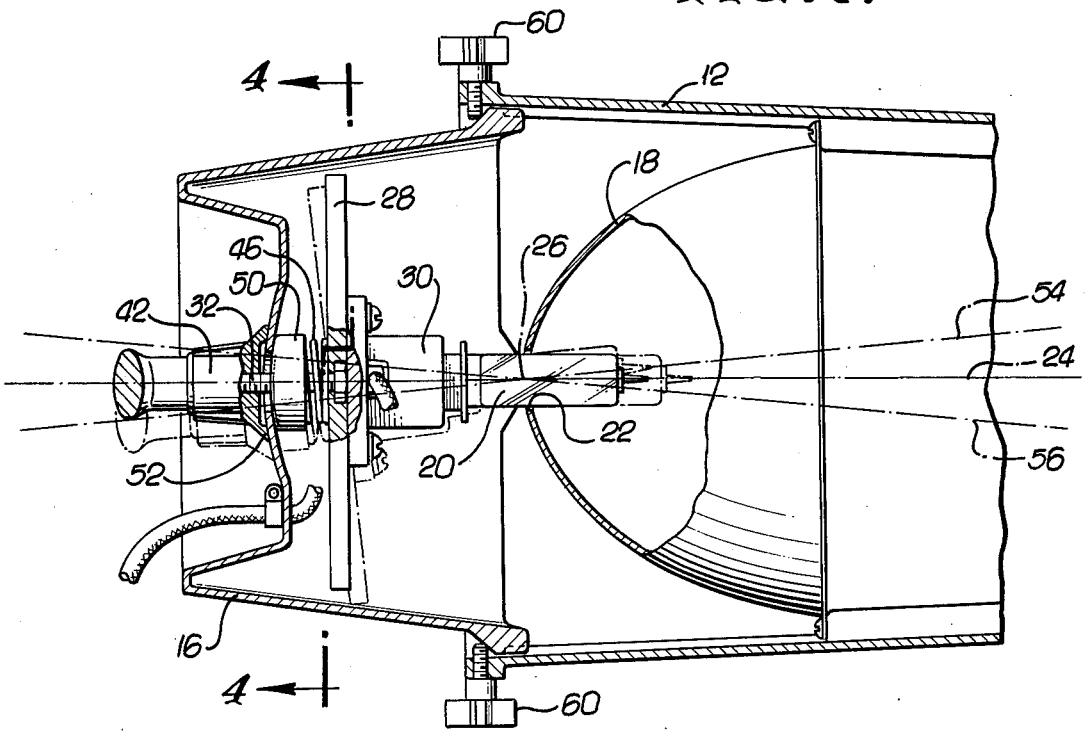
FIG. 2 is an enlarged fragmentary axial sectional view taken along a plane corresponding to line 2—2 of FIG. 1.

The spring 46 provides enough force yieldingly to clamp the assembly in position. The geometric center of the spherical wall is the pivot point 26 (FIG. 2). Accordingly, by sliding the knob 42 along the wall 40, the lamp 20 swivels about the pivot point 26 as indicated by phantom lines 54 and 56. Lateral adjustment or alignment of the lamp is accordingly achieved.

By rotating the knob 42, the lamp 20 is projected or retracted according to the direction of rotation of the knob. As the knob rotates, the entire support or heat sink 28 tends to rotate with it. However, the heat sink is noncircular so that its corners interfere with the peripheral walls of the lamp housing section 14. Accordingly, after a very slight lost motion, the knob rotates on the rod 32, retracting the support 28 or permitting it to advance under the power of the spring 46. A stop ring 58 at the outer end of the rod 32 limits the advancing movement of the lamp socket 30 and associated parts.

Simple, direct manipulations of the knob 42 cause desired positioning of the lamp filament either during use or following replacement of the lamp. In order to replace the lamp, the housing section 16 is detached. Any suitable mechanism, such as locking screws 60, are provided.

The wall 40 is recessed inwardly of the lamp housing section 16. This arrangement shields the knob from accidental movement from adjusted position. A bar handle for moving the luminaire extends across the back of the housing section 14 and further shields the knob 42.

Intending to claim all novel, useful and unobvious features shown or described, I make the following claims:

1. In a stage luminaire or the like:

a. a luminaire housing including a reflector housing section and a lamp housing section, said lamp housing section having a rear wall formed substantially as a spherical segment;

b. a reflector mounted in said reflector housing section and having a central access opening;

c. a lamp socket support located between said reflector and said rear wall of said lamp housing section;

d. a lamp socket carried by said support;

e. a manual actuating element located outside said rear wall and conforming to the external spherical configuration thereof;

f. a draw screw connection between said socket support and said manual actuating element, including a part projecting through a clearance hole in said rear wall;

g. spring means urging said support towards said reflector and frictionally urging said manual actuating element into engagement with said rear wall;

h. said socket support being supported only by the frictional engagement of said actuator with said wall section;

i. said rear wall having a center of curvature located forwardly of said wall and substantially at the central access opening of said reflector whereby sliding movement of said actuator across said spherical wall sectional laterally positions a lamp supported by said lamp socket;

j. means limiting angular movement of said support in said housing whereby rotation of said actuator advances and retracts said lamp socket.

2. The combination as set forth in claim 1 in which said support is a heat sink having heat radiating ribs or fins thereon.

3. The combination as set forth in claim 1 in which said support is a heat sink, said heat sink having a noncircular peripheral contour to comprise, by interaction with said housing, the means limiting angular movement thereof.

4. The combination as set forth in claim 1 in which said draw screw connection comprises a machine screw having a noncircular head, said head fitting a corresponding recess in the support, and projecting through said clearance hold in said rear wall, said actuator being a knob provided with a through threaded aperture engaging said machine screw.

5. The combination as set forth in claim 4 in which both the inside and the outside surface of said rear wall are corresponding formed as a segment of a sphere, said spring means comprising a coil spring surrounding said machine screw, there being a boss on said support for locating said spring at one end, the other end of said spring carrying a cup that engages the inside surface of said rear wall.

6. The combination as set forth in claim 1 in which said rear wall is recessed inwardly of said lamp housing section whereby said actuator is shielded from accidental dislodgement.

* * * * *